US007836558B2

(12) United States Patent
Schmitz et al.

(10) Patent No.: US 7,836,558 B2
(45) **Date of Patent: *Nov. 23, 2010**

(54) DEVICE ON A DRAFTING SYSTEM OF A DRAW FRAME FOR TEXTILE FIBRE SLIVERS

(75) Inventors: Thomas Schmitz, Mönchengladbach (DE); Helmut Ilmberger, Ingolstadt (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 177 days.

This patent is subject to a terminal disclaimer.

(21) Appl. No.: 12/195,247

(22) Filed: Aug. 20, 2008

(65) Prior Publication Data

US 2009/0052824 A1 Feb. 26, 2009

(30) Foreign Application Priority Data

Aug. 21, 2007 (DE) ..... 10 2007 039522

(51) Int. Cl.
*D01H 5/74* (2006.01)

(52) U.S. Cl. ..... 19/258; 19/266

(58) Field of Classification Search ..... 19/236, 19/258, 266

See application file for complete search history.

(56) References Cited

U.S. PATENT DOCUMENTS

| | | | | |
|---|---|---|---|---|
| 2,389,581 A | | 11/1945 | Tarr | |
| 2,749,191 A | | 6/1956 | Cole et al. | |
| 3,140,129 A | * | 7/1964 | Koss | 384/477 |
| 3,424,507 A | * | 1/1969 | Moroney et al. | 384/454 |
| 3,923,350 A | * | 12/1975 | Berry | 384/494 |
| 5,997,050 A | * | 12/1999 | Fleckenstein et al. | 285/332 |
| 5,997,184 A | | 12/1999 | Röder | |
| 6,588,560 B1 | * | 7/2003 | Fujiwara | 192/45 |

(Continued)

FOREIGN PATENT DOCUMENTS

| | | |
|---|---|---|
| DE | 968 448 | 2/1958 |

(Continued)

OTHER PUBLICATIONS

UK Intellectual Property Office Search Report, dated Dec. 5, 2008, issued in connection with counterpart British Application No. GB0815187.0.

(Continued)

*Primary Examiner*—Shaun R Hurley
(74) *Attorney, Agent, or Firm*—Venable LLP; Robert Kinberg; Ryan M. Flandro

(57) ABSTRACT

In a device on a drafting system for textile fiber slivers with weighting of the upper rolls of the drafting system which comprises roll pairs arranged one behind the other, the pairs having lower and upper rolls, the rotating journals at the ends of the upper roll are mounted by means of bearing elements and the bearing elements each have at least one rolling-element bearing having an immovable outer housing (outer ring) and an internal rotational body (inner ring). In order to provide a structurally simple way in which the bearing housings can be mounted on or removed from the presser roll in a simple, quick and reliable manner, the bearing elements are in the form of rolling-element bearings and there is a coupling between the journal and the rotational body.

23 Claims, 6 Drawing Sheets

U.S. PATENT DOCUMENTS

| | | | | |
|---|---|---|---|---|
| 7,004,861 | B2 * | 2/2006 | Fujiwara | 474/74 |
| 2002/0194707 | A1 | 12/2002 | Strobel et al. | |
| 2005/0163409 | A1 | 7/2005 | Smith et al. | |
| 2009/0049652 | A1 * | 2/2009 | Schmitz | 19/258 |

FOREIGN PATENT DOCUMENTS

| | | | |
|---|---|---|---|
| DE | 1 057 964 | | 5/1959 |
| DE | 38 01 880 | C2 | 8/1989 |
| DE | 41 41 266 | A1 | 6/1993 |
| DE | 10 2004 061 451 | A1 | 6/2006 |

OTHER PUBLICATIONS

German Search Report dated Nov. 26, 2007, directed to counterpart DE Application No. 10 2007 039 522.3. (8 pages).

* cited by examiner

DEVICE ON A DRAFTING SYSTEM OF A DRAW FRAME FOR TEXTILE FIBRE SLIVERS

CROSS-REFERENCE TO RELATED APPLICATION

This application claims priority from German Patent Application No. 10 2007 039522.3 dated Aug. 21, 2007, the entire disclosure of which is incorporated herein by reference.

BACKGROUND OF THE INVENTION

The invention relates to a device on a drafting system of a draw frame for textile fibre slivers. In a known system there is weighting of the upper rolls of the drafting system which comprises roll pairs arranged one behind the other, the pairs having lower and upper rolls, and the rotating journals at the ends of the upper roll are mounted by means of bearing elements and the bearing elements each have at least one rolling-element bearing having an immovable outer housing (outer ring) and an internal rotational body (inner ring).

In a drafting system according to German Patent Specification No 968 448, a rolling-element bearing arrangement is housed on each side of the presser roll in a special bearing housing which can be removed from the journals of the presser roll. For each journal there is provided in the bearing housing at least one rolling-element bearing for absorbing the roll weighting (transverse weighting). The rolling-element bearing is in the form of a needle bearing, roller bearing or ball bearing. A second rolling-element bearing or plain bearing is present to absorb the roll traction (axial shear forces). The presser roll is provided with press-fitted journals at both ends.

In accordance with a first embodiment, bearing housings each contain two roller bearings, the journals of the presser roll being mounted directly on the rollers. The roller bearings have an immovable outer ring which is fixed in the bearing housing. The roller bearings form separate components. When the bearing housings are being removed, the rollers have to be secured against falling out. A further construction comprises a needle bearing for absorbing the presser roll weighting and a plain bearing for absorbing the roll traction. In the same way as the roller bearings, the needle bearings form a separate component having an outer ring, and the needles have to be secured against falling out during demounting. In accordance with a third proposal having a roller bearing for absorbing the presser roll weighting, the bearing housing of the presser roll with its bearings can, by means of a screw connection, be removed from the roll journal for the purpose of applying a covering or for grinding the covering or for lubricating the bearings. Once they have been pulled outwards, the bearing housings can be unscrewed from the body of the roll. The body of the roll and the journals form a unit. In accordance with a fourth concept, a presser roll having a ball bearing for absorbing the weighting and the roll shear and a needle bearing for absorbing the roll traction are provided. The ball bearing is a separate component having its own outer and inner rings which are supported against the bearing housing and the journal, respectively. A particular problem is that the bearing housing of the presser roll here cannot be removed from the journal. A fifth embodiment provides a presser roll having a roller bearing for absorbing the roll weighting and a ball bearing for absorbing the roll traction and roll shear. The roller bearing and the ball bearing form separate components, which is expensive. In the same way as in the described third construction, the bearing housing of the presser roll is arranged on the journal so as to be removable by means of displacement and a screw connection.

SUMMARY OF THE INVENTION

It is an aim of the invention to provide a device of the kind described at the beginning which avoids or mitigates the mentioned disadvantages, which is structurally simple and which enables the bearing housings to be mounted on and removed from the presser roll in a simple, quick and reliable manner.

The present invention provides a device on a drafting system for textile fibre slivers, which comprises:

- a plurality of roll pairs arranged one behind the other, the pairs having lower and upper rolls with journals, and the upper rolls being weighted; and
- bearing elements by means of which the rotating journals at the ends of a said upper roll are mounted, the bearing elements comprising an immovable outer housing and an internal rotational body;
- wherein the bearing elements comprise rolling-element bearings, and wherein there is a coupling between the journal and the rotational body.

Because the bearing elements are in the form of rolling-element bearings, the functions of the rolling-element bearings and of the bearing element are advantageously fused with one another. The rolling-element bearing arrangement is integrated into the bearing housing. The coupling between the journals and the rotational bodies of the rolling-element bearing or bearing element provides an especially elegant way in which the bearing housings can be mounted on or removed from the presser roll in a simple, quick and reliable manner. At the same time, the coupling ensures reliable transmission of force between the rotational body and the journal, that is to say torque transmission with rapid disconnection and connection is advantageously realised. In accordance with a preferred construction, the common engagement surfaces of the journal and of the rotational body are each of tapered construction, which allows self-centring. A tapered connection transmits high torques with low axial forces and exhibits very low concentricity tolerances.

The rotational body, which is coupled to the journal of the roll, is rotatable with respect to the outer housing, which during use is immovable. In one preferred embodiment, the rolling bodies roll on the inside wall surface of the bearing housing and on the outside wall surface of the rotational body. In certain preferred embodiments, there are at least two rolling-element bearings for each bearing element. In one embodiment, the rolling-element bearings comprise two deep-groove ball bearings. In another embodiment, there is a ball bearing, preferably a deep-groove ball bearing, and a roller bearing, for example a needle bearing, for each bearing element.

In some embodiments, the rotational bodies each project beyond at least one end face of the bearing elements. In that case, the coupling between journal and rotational body may be arranged outside the bearing element. In other embodiments, the journal may engage in an inner space of the bearing element. In that case, the coupling between journal and rotational body may be arranged inside the bearing element.

Advantageously, the common engagement surfaces of the journal and of the rotational body are each of tapered construction. Advantageously, the coupling has a steep-angle taper connection. Advantageously, the rotational body and the roller journal have co-operating structures. Advantageously, the co-operating structure on the roller journal is integrally formed with the roller journal. Advantageously, the co-operating structure on the rotational body is integrally formed with the rotational body. In some embodiments, a cone or truncated cone is formed on the rotational body. In that case, for cooperation therewith, there is advantageously a cone-shaped or truncated-cone-shaped recess in the journal. Advantageously, the cone or truncated cone on the rotational body engages in the cone-shaped or truncated-cone-shaped recess of the journal. In other embodiments, there is a cone-shaped or truncated-cone-shaped recess in the rotational body. In that case, for co-operation therewith, a cone or truncated cone may be formed on the journal. Advantageously, the cone or truncated cone on the journal engages in the cone-shaped or truncated-cone-shaped recess of the rotational body. In a further embodiment, a cylinder or hollow cylinder is formed on the rotational body. In that case, for co-operation therewith, there may be a cylindrical or hollow-cylindrical recess in the journal. Advantageously, the cylinder or hollow cylinder on the rotational body engages in the cylindrical or hollow-cylindrical recess of the journal. In yet another embodiment, there is a cylindrical or hollow-cylindrical recess in the rotational body. In that case, for co-operation therewith, a cylinder or hollow cylinder may be formed on the journal. Advantageously, the cylinder or hollow cylinder on the journal engages in the cylindrical or hollow-cylindrical recess on the rotational body. Advantageously, there is a fixing element, for example, a fixing screw or the like, for the fixing between the journal and the rotational body. Advantageously, the fixing screw is associated with a securing ring. Advantageously, the bearing elements are axially displaceable after the fixing elements have been loosened.

The components of the rolling-element bearings may be of any suitable material having regard to their function. Advantageously, the rolling bodies of the rolling-element bearing consist of ball bearing steel, for example 100 Cr 6. Advantageously, the bearing housing and the rotational body consist of ball bearing steel, for example 100 Cr 6.

Preferably, each bearing element has a roller bearing. In some embodiments, two rolling-element bearings per bearing element are arranged in a bearing housing. Advantageously, the rolling bodies of the rolling-element bearing consist of hard material, for example $Si_3N_4$.

As already mentioned, in some preferred embodiments there are two rolling-element bearings. Each bearing element may moreover include a plain bearing.

In some preferred embodiments, the body of the roll and the roll journals are of monolithic construction.

Advantageously, there is a screw coupling having a tapered guide means.

The invention further provides a device on a drafting system for textile fibre slivers with weighting of the upper rolls of the drafting system which comprises roll pairs arranged one behind the other, the pairs having lower and upper rolls, in which device the rotating journals at the ends of the upper roll are mounted by means of bearing elements and the bearing elements each have at least one roller-element bearing having an immovable outer housing (outer ring) and an internal rotational body (inner ring), characterised in that the bearing elements are in the form of rolling-element bearings and there is a coupling between the journal and the rotational body.

DETAILED DESCRIPTION OF CERTAIN EMBODIMENTS

Figure 1:
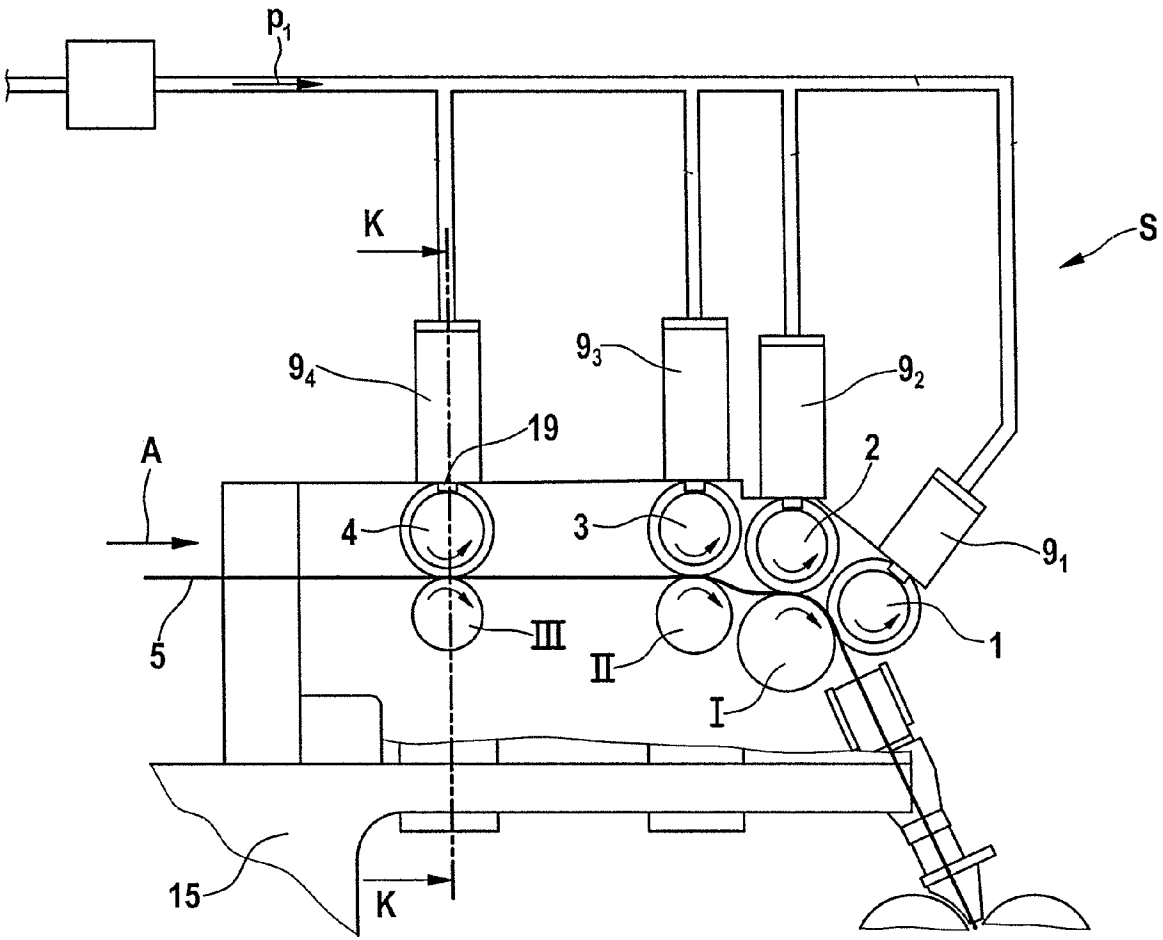
FIG. 1 is a diagrammatic side view of the drafting system of a draw frame having the device according to the invention.

FIG. 1 shows a drafting system S of a draw frame, for example a draw frame TC 03 made by Trützschler GmbH & Co. Kg of Mönchengladbach, Germany. The drafting system S is configured as a 4 over 3 drafting system, that is to say it consists of three lower rolls I, II, III (I output lower roll, II middle lower roll, III input lower roll) and four upper rolls 1, 2, 3, 4. In the drafting system S, the drafting of the fibre bundle 5, which consists of a plurality of fibre slivers, is carried out. The drafting operation is composed of the preliminary drafting operation and the main drafting operation.

The roll pairs 4/III and 3/II form the preliminary drafting zone and the roll pairs 3/II and 1,2/I form the main drafting zone. The output lower roll I is driven by the main motor (not shown) and thus determines the delivery speed. The input and middle lower rolls III and II are driven by a regulating motor (not shown). The upper rolls 1 to 4 are pressed against the lower rolls I, II, III by presser elements $\mathbf{9}_1$ to $\mathbf{9}_4$ (weighting device) in corresponding presser arms 11*a* (see FIG. 3) which are pivotable about pivot bearings 10 (see FIGS. 2, 3) and are thus driven by way of frictional engagement. The direction of rotation of the rolls I, II, III; 1, 2, 3, 4 is indicated by curved arrows. The fibre bundle 5, which consists of a plurality of fibre slivers, runs in direction A. The lower rolls I, II, III are mounted in stands 14*a* (see FIGS. 2, 3) which are arranged on the machinery frame 15.

Figure 2:
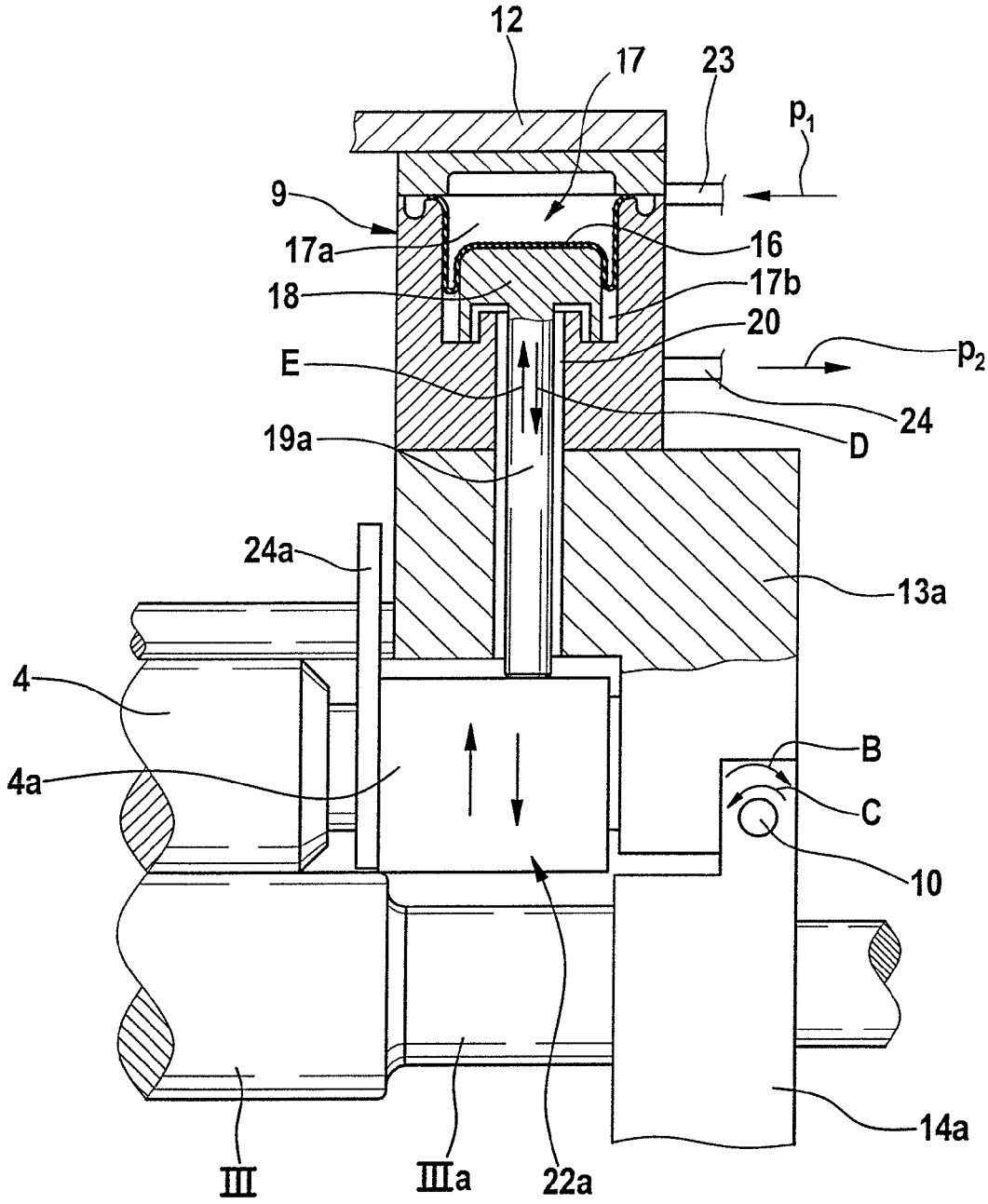
FIG. 2 shows a portion of FIG. 1 in section corresponding to K-K (FIG. 1) with a pneumatic upper roll weighting device.

As shown in FIG. 2, the pneumatic cylinder 9 is associated at the top with a support element 12 and at the bottom with a holding element 13*a*. The pneumatic cylinder 9 forms a cylinder unit with a cylinder cavity 17 comprising two portions 17*a* and 17*b* in which a piston 18 is guided by means of a presser rod 19 in a sliding bush 20. The roll journal 4*a* of the presser roll 4, passing through an opening in a holding bracket 24*a*, engages in a bearing 22*a*. The bearing 22*a* accommodating the presser roll 4 extends into a space between the presser rod 19 and the roll journal III*a* of the lower roll III. The bearing 22*a* is mounted on a holding element 13*a* . A membrane 16 divides the cylinder cavity 17 in terms of pressure. In order that pressure is generated in the upper portion of the cylinder cavity 17, the latter can be supplied with compressed air $p_1$ by means of a compressed air connection 23. The lower portion of the cylinder cavity 17 is vented by means of a venting bore 24. The upper portion of the cylinder cavity 17 can be vented and the lower portion of the cylinder cavity 17 can be supplied with compressed air $p_2$ in corresponding manner. In operation, after a fibre bundle 5 has been guided over the lower rolls I, II, III, the presser arms 11*a* are pivoted about respective pivot bearings 10 into the operating position shown in FIG. 1 and fixed in that position by a fastening (locking) device (not shown), so that the presser rolls I, II, III are able to exert pressure. Such a pressing action is produced on the one hand by the fact that the presser rods 19 each rest on the corresponding bearing 22*a* and on the other hand because an overpressure has been generated in the cavity above the membrane 16. As a result, the presser rod 19 presses with its other end on the bearing 22*a* in order to create the mentioned pressing action between the upper roll 4 and the lower roll (drive roll) III. The presser rod 19 is displaceable in the direction of arrows D, E.

Figure 3:
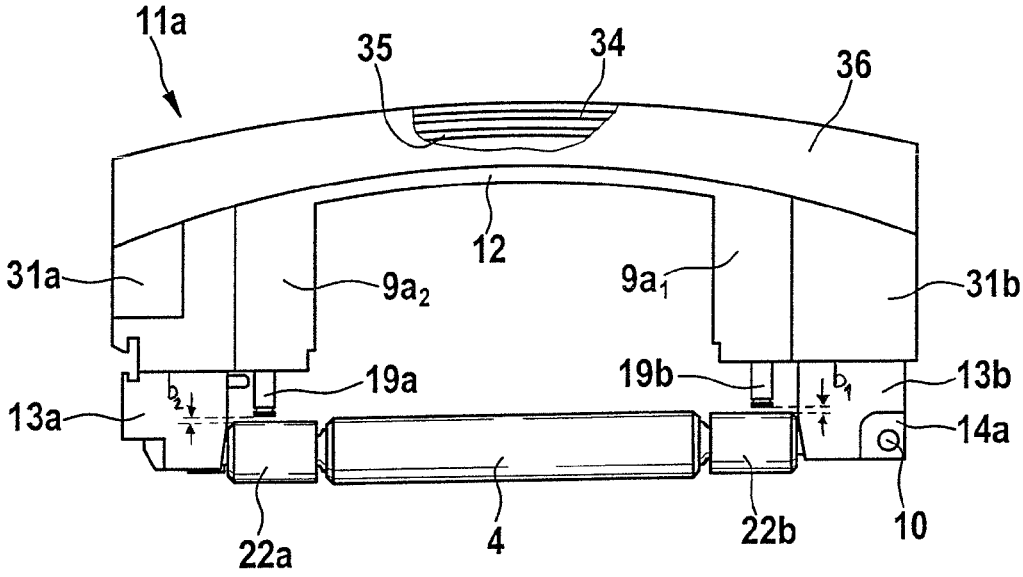
FIG. 3 is a front view of a presser arm having an integral housing and two presser rods.
Figure 3A:
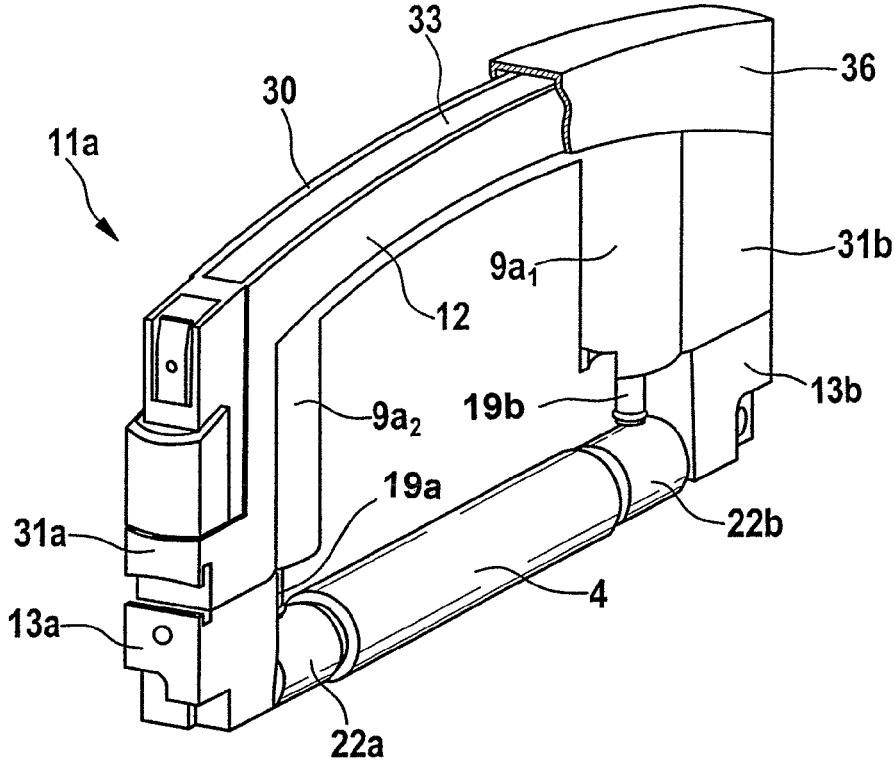
FIG. 3*a* is a perspective view of the presser arm according to FIG. 3.

According to FIGS. 3 and 3*a*, the upper roll 4 is associated with the portal-shaped presser arm 11*a*. (Each of the upper rolls 2 to 4 are associated with a corresponding presser arm-not shown). The presser arm 11*a* is in the form of a housing 30 made of glass-fibre-reinforced plastics and is produced by injection-moulding. The housing 30 is an integral component which is of unitary construction and comprises the support element 12, the two bodies of the presser elements $9a_1$ and $9a_2$ (pressure cylinders), two intermediate elements 31*a* and 31*b* and two holding elements 13*a* and 13*b*. The support element 12 is in the form of a channel of approximately U-shaped cross-section that is open on one side, in the interior of which pneumatic lines 34 and electrical leads 35 are arranged. The open side of the channel 33 is closable by a removable cover 36 which consists of glass-fibre-reinforced plastics, is approximately U-shaped in cross-section and is resilient so that it is attached to the channel 33 by a press-fit connection. The housing 30 is preferably formed in one piece. The integral housing 30, which combines all essential functional elements for holding and weighting the respective transverse rolls 1 to 4, is in this way economical to produce. At the same time, the entire presser arm 11*a* is in simple manner pivotable about the pivot bearing 10 in directions B, C (see FIG. 2) and can be locked and unlocked by the locking device (not shown). The presser rods 19*a* and 19*b* are relieved of load and are thus lifted away from the bearings 22*a* and 22*b* of the upper roll 4 at distance $b_1$, $b_2$, respectively.

Figure 4:
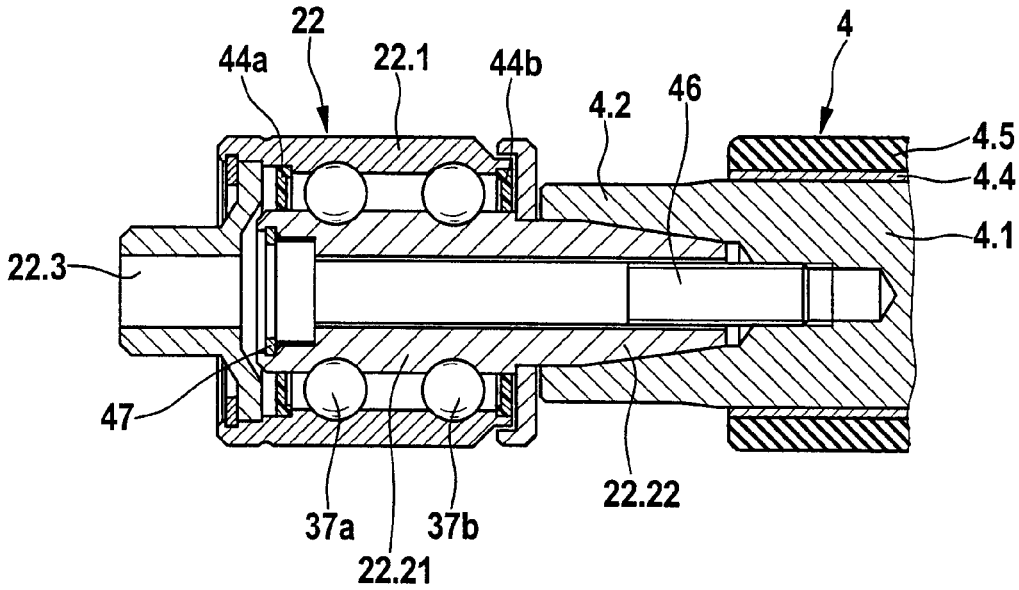
FIG. 4 is a cross-section through an embodiment having two deep-groove ball bearings and a tapered coupling.
Figure 4A:
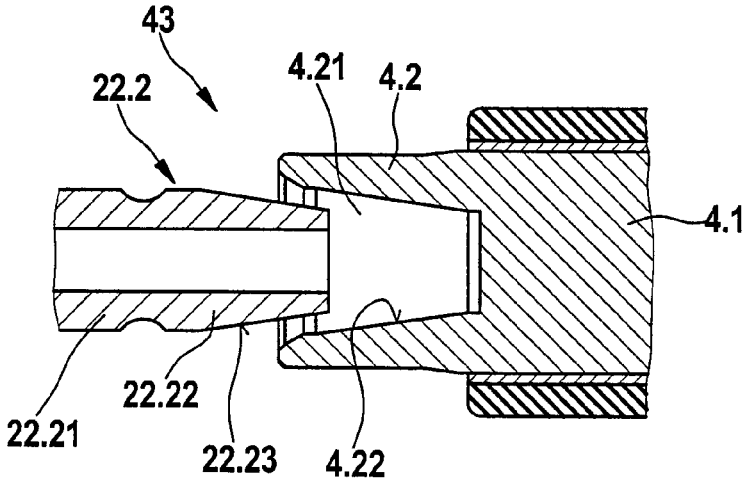
FIG. 4*a* is an exploded view of the coupling according to FIG. 4.

A first embodiment of the invention is illustrated in FIG. 4. According to FIG. 4, the bearing element 22 for the bearing arrangement of the upper roll 4 (presser roll) is in the form of a rolling-element bearing. The immovable bearing housing 22.1 forms the outer ring and the rotational body 22.2 forms the inner ring of the rolling-element bearing. In the cylindrical inside wall surface of the bearing housing 22.1 and in the cylindrical outside wall surface of the rotational body 22.2 there are provided, for example by grinding, in each case two circumferential annular grooves (raceways) in which balls 37*a*, 37*b*, for example made of 100 Cr 6, run. In that way, two deep-groove ball bearings are formed. Opposite the outer sides of the balls 37*a*, 37*b* there are arranged two circumferential seals 44*a*, 44*b* which seal the space between bearing element 22 and rotational body 22.2 and which are sealed with a lubricant, for example grease. The rotational body 22.2 is of one-piece construction and consists of a hollow-cylindrical portion 22.21 and a truncated-cone-shaped portion 22.22 having a truncated-cone-shaped wall surface 22.23 (see FIG. 4*a*). The hollow-cylindrical portion 22.21 is located inside the cylindrical inner cavity of the bearing housing 22.1, while the truncated-cone-shaped portion 22.22 projects beyond an end face of the bearing housing 22.1. The upper roll 4, for example made of steel, consists of a roll core 4.1 and two external journals 4.2 and 4.3 (only 4.2 shown). The resilient roll covering 4.5 is arranged, by means of an intermediate layer 4.4 (holding layer), on the roll core 4.1. The roll journals 4.2 and 4.3 (only 4.2 shown) have a truncated-cone-shaped recess 4.21, which is open at one end, having a truncated-cone-shaped wall surface 4.22 (see FIG. 4*a*). In operation (FIG. 4), the truncated-cone-shaped portion 22.22 and the truncated-cone-shaped recess 4.21 are in contact with one another and in non-positive engagement with one another by means of the truncated-cone-shaped wall surfaces 22.23 and 4.22. FIG. 4 shows the coupled state and FIG. 4*a* the uncoupled state. In that way, a coupling 43 is formed. The truncated-cone-shaped portion 22.22 of the rotational body 22.2 engages in the truncated-cone-shaped recess 4.21, which is open at one end, outside the bearing housing 22.1. The rotational body 22.2 has axially a cylindrical bore 22.3 through which a fixing screw 46, which secures the parts 22.22 and 4.2 in the coupled state, passes. In addition, the head of the screw 46 is associated with a securing ring 47. In that way, an upper roll bearing arrangement is implemented by means of deep-groove ball bearings. The bearing arrangement is configured as a two-row special-purpose bearing. The bearing arrangement has lifetime greasing nd is especially sealed. The connection to the upper roll core 4.1 is made by means of a steep-angle taper connection. That connection transmits high torques with low axial forces and exhibits very low concentricity tolerances. The axial forces that arise are absorbed by the deep-groove ball bearing arrangement. By means of the fixing screw 46, when the connection is loosened the bearing unit is ejected by means of the securing ring 47, so that no jamming can occur.

Figure 5:
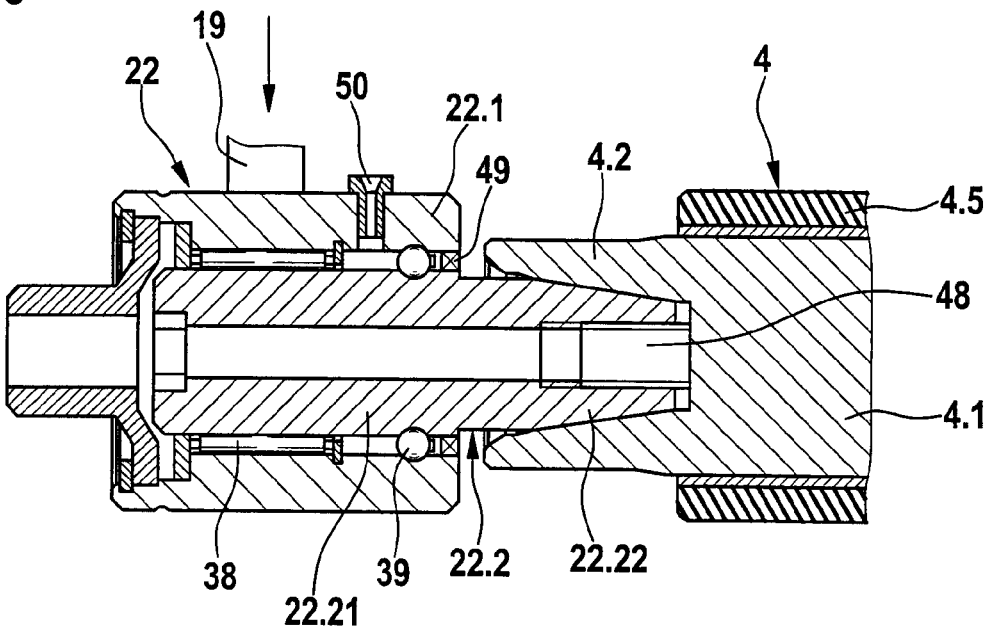
FIG. 5 is a cross-section through an embodiment having a needle bearing and a ball bearing and a tapered coupling.

FIG. 5 shows a construction which is similar to FIG. 4 (the same or corresponding components being indicated by the same reference numerals) but in which there is a needle bearing having needles 38 for absorbing the radial forces (surface weighting). For absorbing the axial forces there is provided a deep-groove ball bearing having balls 39. Reference numeral 48 denotes an internal screw. The outer thread of the screw 48, which is arranged in the recess 4.21 (see FIG. 4*a*), co-operates with an internal thread in the end region of the bore 22.3. The cone connection 43 (see FIG. 4*a*) becomes self-locking the first time torque is introduced. The self-centring and self-locking conical seat has a high degree of concentricity accuracy. The axial force absorption is effected by ball bearings 39 (raceway produced by grinding). The needle bearing arrangement 38 serves for radial force absorption. It is a sealed system (sealing ring 49), so that there is no ingress of fibres. There can be long intervals between lubrications. The system can be re-lubricated by means of lubricating nipples 50. The cone can be released by means of an internal, Loctite-secured ejection screw 48 using, for example, a socket wrench. When rolling bodies (needles 38 and/or balls 39) made of $Si_3N_4$ are used, an anti-magnetic, low-friction hybrid bearing arrangement can be achieved. Axial play in the presser arm 19 does not give rise to any problems.

Figure 6:
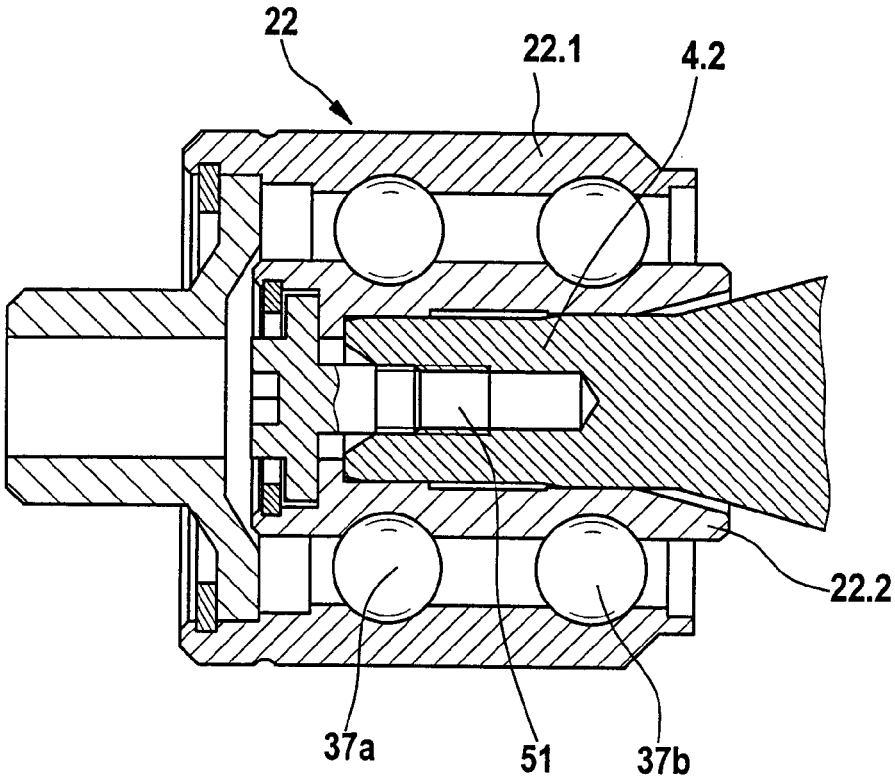
FIG. 6 is a cross-section through an embodiment having a hollow-cylindrical rotational body and a journal engaging therein.

In the embodiment of FIG. 6 there is a hollow-cylindrical rotational body 22.2 in the cylindrical interior of which the hollow-cylindrical journal 4.2 engages interlockingly inside the bearing housing 22.1. The rotational body 22.2 and the journal 4.2 are connected and secured by a screw connection 51.

Figure 7:
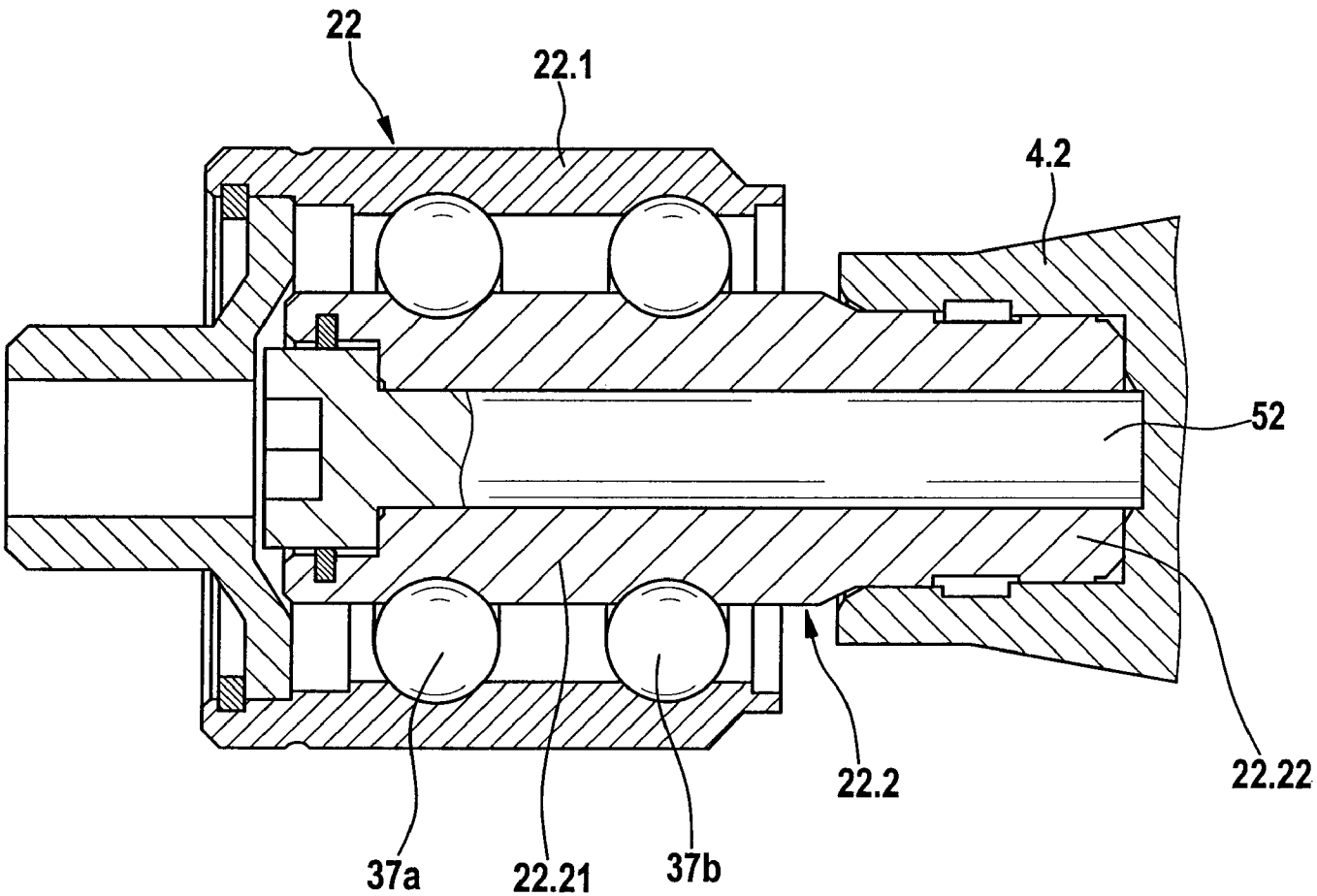
FIG. 7 is a cross-section through an embodiment having a hollow-cylindrical journal and a rotational body engaging therein.

FIG. 7 shows an embodiment which is similar to FIG. 4 but in which the hollow-cylindrical portion 22.22 of the rotational body 22.2 engages in a cylindrical recess, which is open at one end, of the journal 4.2 outside the bearing housing 22.1. The rotational body 22.2 and the journal 4.2 are connected and secured by a screw connection 52.

In the case of the co-operating lower and upper rolls of a roll pair (see FIG. 1), the upper rolls of which are subject to the action of weighting exerted on the ends of the roll shafts (journals), it does happen that the axes of the two rolls are arranged so that they intersect at a certain (very small) angle.

The cause may lie, for example, in very slight manufacturing tolerances. In such a case, the upper roll exerts axial forces on the upper roll bearing that are advantageously compensated for by the device according to the invention.

Although the foregoing invention has been described in detail by way of illustration and example for purposes of understanding, it will be obvious that changes and modifications may be practised within the scope of the appended claims.

What we claim is:

1. A device on a drafting system for textile fiber slivers, which comprises:

a plurality of roll pairs arranged one behind the other, the pairs having lower and upper rolls with journals, and the upper rolls being weighted; and bearing elements by means of which the rotating journals at the ends of a said upper roll are mounted, the bearing elements in the form of rolling-element bearings and comprising:

an immovable outer housing;

an internal rotational body, wherein there is a coupling between the journal and the rotational body; and a fixing element releaseably securing the journal and the rotational body.

2. A device according to claim 1, wherein rolling bodies of the rolling-element bearings roll on an inside wall surface of the outer housing and on an outside wall surface of the rotational body.

3. A device according to claim 2, in which there are at least two rolling-element bearings for each bearing element.

4. A device according to claim 3, in which the rolling-element bearings are deep-groove ball bearings.

5. A device according to claim 3, in which there is a deep-groove ball bearing and a needle bearing for each bearing element.

6. A device according to claim 1, in which the rotational bodies each project beyond at least one end face of the bearing element.

7. A device according to claim 6, in which the coupling between journal and rotational body is arranged outside the bearing element.

8. A device according to claim 1, in which the journal engages in an inner space of the bearing element.

9. A device according to claim 8, in which the coupling between journal and rotational body is arranged inside the bearing element.

10. A device according to claim 1, in which the common engagement surfaces of the journal and of the rotational body are each of tapered construction.

11. A device according to claim 1, in which a cone or truncated cone is formed on one of the rotational body and the journal and there is a cone-shaped or truncated-cone-shaped recess in the other of the rotational body and the journal.

12. A device according to claim 11, in which the rotational body and the journal are so arranged relative to one another that the cone or truncated cone engages in the cone-shaped or truncated-cone-shaped recess.

13. A device according to claim 1, in which a cylinder or hollow cylinder is formed on one of the rotational body and the journal and there is a cylindrical or hollow-cylindrical recess in the other of the rotational body and the journal.

14. A device according to claim 13, in which the rotational body and the journal are so arranged relative to one another that the cylinder or hollow cylinder engages in the cylindrical or hollow-cylindrical recess.

15. A device according to claim 1, in which the fixing element fixes the journal and the rotational body.

16. A device according to claim 15, in which the fixing element is associated with a securing ring.

17. A device according to claim 1, in which rolling bodies of the rolling-element bearing and/or the bearing housing and/or the rotational body consist of ball bearing steel.

18. A device according to claim 1, in which there is a roller bearing for each bearing element.

19. A device according to claim 1, in which there is a plain bearing for each bearing element.

20. A device according to claim 1, in which a body of the upper roll and the journals is of one-piece construction.

21. A device according to claim 1, in which two rolling-element bearings per bearing element are arranged in a bearing housing.

22. A device according to claim 1, in which there are fixing elements for fixing the bearing elements in position in use and the bearing elements are axially displaceable after the fixing elements have been loosened.

23. A device according to claim 1, in which there is a screw coupling having a tapered guide means.

* * * * *